US006752653B1

(12) United States Patent
Morlock et al.

(10) Patent No.: US 6,752,653 B1
(45) Date of Patent: Jun. 22, 2004

(54) ELECTRICAL EXTENSION CORD WITH CAPABILITY FOR MULTI-POSITIONAL FIXED MOUNTING

(76) Inventors: Mark J. Morlock, 795 Churchill Dr., Chico, CA (US) 95973; Steven J. Masonek, 7475 Cana Hwy., Chico, CA (US) 95973; Frederick N. Rabo, 2120 Oroville-Chico Hwy., Durham, CA (US) 95938

( * ) Notice: Subject to any disclaimer, the term of this patent is extended or adjusted under 35 U.S.C. 154(b) by 0 days.

(21) Appl. No.: 10/261,716

(22) Filed: Sep. 30, 2002

Related U.S. Application Data

(63) Continuation of application No. 09/976,852, filed on Oct. 12, 2001, now Pat. No. 6,485,327.
(60) Provisional application No. 60/240,477, filed on Oct. 13, 2000.

(51) Int. Cl.[7] ..... H01R 13/60

(52) U.S. Cl. ..... 439/527; 439/216; 439/532; 439/654; 439/716; 439/954; 439/535; 439/570

(58) Field of Search ..... 439/527, 216, 439/532, 654, 716, 954, 570, 535

(56) References Cited

U.S. PATENT DOCUMENTS

| | | | | |
|---|---|---|---|---|
| 671,486 | A | | 4/1901 | Laumann |
| 2,177,718 | A | | 10/1939 | Irvine |
| 3,365,156 | A | | 1/1968 | Beck |
| 4,384,756 | A | * | 5/1983 | Simonovich et al. ..... 439/53 |
| 4,504,108 | A | | 3/1985 | Fiumefreddo et al. |
| 4,792,881 | A | * | 12/1988 | Wilson et al. ..... 361/827 |
| 4,867,701 | A | | 9/1989 | Wiand |
| 4,918,258 | A | | 4/1990 | Ayer |
| 5,289,934 | A | | 3/1994 | Smith et al. |
| 5,582,520 | A | | 12/1996 | Doudon |
| 5,727,865 | A | | 3/1998 | Caldwell |
| 6,010,363 | A | | 1/2000 | Dobrich et al. |
| 6,077,109 | A | | 6/2000 | Prazoff |
| 6,142,813 | A | | 11/2000 | Cumming et al. |
| 6,193,550 | B1 | | 2/2001 | Yamashita et al. |
| 6,300,570 | B1 | * | 10/2001 | Lai ..... 174/67 |
| 6,551,135 | B2 | * | 4/2003 | Stekelenburg ..... 439/575 |

* cited by examiner

*Primary Examiner*—Truc Nguyen
(74) *Attorney, Agent, or Firm*—John P. O'Banion

(57) ABSTRACT

An electrical extension cord assembly including a cord having a male plug attached to one end and a female receptacle head attached to the other end of the cord. The receptacle head is configured so that it can removably engage a base plate that is attached to a stationary object.

46 Claims, 11 Drawing Sheets

ELECTRICAL EXTENSION CORD WITH CAPABILITY FOR MULTI-POSITIONAL FIXED MOUNTING

CROSS-REFERENCE TO RELATED APPLICATIONS

This application is a continuation of U.S. application Ser. No. 09/976,852 filed on Oct. 12, 2001, now U.S. Pat. No. 6,485,327, which claims priority from U.S. provisional application Serial No. 60/240,477 filed on Oct. 13, 2000, incorporated herein by reference.

STATEMENT REGARDING FEDERALLY SPONSORED RESEARCH OR DEVELOPMENT

Not Applicable

REFERENCE TO A COMPUTER PROGRAM APPENDIX

Not Applicable

BACKGROUND OF THE INVENTION

1. Field of the Invention

The present invention relates generally to electrical extension cords, and more particularly to an extension cord apparatus that can be reversibly mounted in multiple positions to mounting plates in a variety of locations.

2. Description of the Background Art

Electrical extension cords are commonplace in home and commercial settings. Conventional extension cords normally include two or three wires within a insulating jacket that are connected at one end to a male plug and at the other end to a head that contains one or more female receptacles. Extension cord heads fall into two general classes; namely, those that can be permanently mounted on a surface, and those that are non-mountable.

Mountable extension cords are advantageous in commercial applications such as construction sites where loose extension cords can be extremely dangerous. Typically, extension cord heads known in the art are mounted in one of two ways.

First, the head can include an eyelet through which a fastener, e.g., a screw or nail, can be installed to hold the head to a stationary object such as a wall. The durability of the head is limited by the strength of the eyelet that may tear if the extension cord is pulled.

The second type of mounting system has a head with a keyhole slot in the back of the head. The keyhole slot allows the head to slide over the head of a screw that has been partially screwed into a surface. This type of mounting also lacks durability and the attachment to the surface is not very secure.

In the first configuration described above, the head is securely fastened-to the stationary object, but it cannot be easily detached. In contrast, the second configuration described above provides a means by which the head can be detached, but does not provide a very secure connection between the head and the stationary object.

Accordingly, there is a need for an extension cord assembly that can be securely attached to a stationary object during use and be detached relatively easily from the object and transferred to another location.

BRIEF SUMMARY OF THE INVENTION

An extension cord assembly according to the present invention includes an electrical cord that defines a first end and a second end. A male plug is attached to the first end of the electrical cord and a female receptacle head is attached to the second end of the electrical cord. The receptacle head preferably includes a plurality of female electrical receptacles. The female receptacle can be formed in a flat surface of the head or in a beveled surface formed by the head. The extension cord assembly further includes a base plate that can be attached to a stationary object. In tum, the receptacle head can be removably attached to the base plate.

Preferably, the receptacle head is formed with a dovetail-shaped groove and the base plate is formed with a correspondingly dimensioned dovetail-shaped tongue. The tongue of the base plate slidably engages the groove of the receptacle head to secure the receptacle head to the base plate. Conversely, in one embodiment, the groove is formed within the base plate and the tongue is present on the receptacle head. Or, in lieu of a tongue-and-groove configuration, the receptacle head can include two tabs that engage two correspondingly sized and shaped slots formed by the base plate in order to snap the receptacle head to the base plate.

In a preferred embodiment, the cord assembly includes a locking mechanism that engages the receptacle head to lock the receptacle head to the base plate. Preferably, the locking mechanism includes two tabs that engage two notches formed by the receptacle head. The tabs are movable between a locked position wherein the receptacle head cannot be removed from the base plate and an unlocked position wherein the receptacle head can be slidably removed from the base plate. In a preferred embodiment, the locking mechanism also includes a button for moving the tabs into the unlocked position.

In another aspect of the present invention, the extension cord assembly includes an electrical cord that defines a first end and a second end. A male plug is attached to the first end of the electrical cord and a female receptacle head is attached to the second end of the electrical cord. The receptacle head includes a female receptacle. This aspect of the present invention further includes a base plate and means for attaching the base plate to a stationary object. Moreover, this aspect includes means for removably attaching the receptacle head to the base plate.

In yet another aspect of the present invention, a female receptacle head for an extension cord includes means for removably engaging the female receptacle head with a base plate.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings that are for illustrative purposes only.

DETAILED DESCRIPTION OF THE INVENTION

Figure 1:
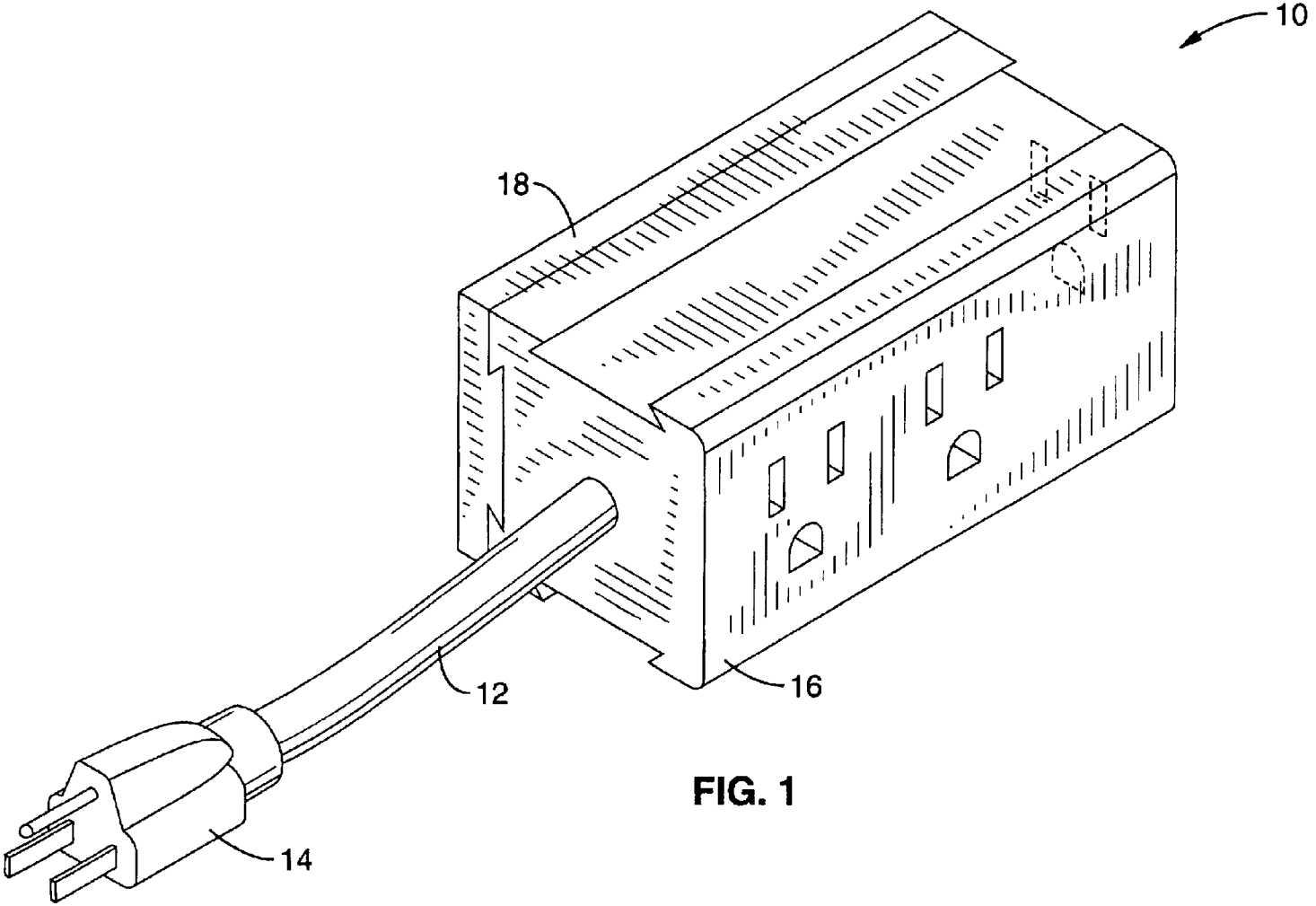
FIG. 1 is a perspective view of an electrical extension cord assembly according to the present invention.

Referring more specifically to the drawings, for illustrative purposes the present invention is embodied in the apparatus generally shown in FIG. 1 through FIG. 19. It will be appreciated that the apparatus may vary as to configuration and as to details of the parts without departing from the basic concepts as disclosed herein.

Referring initially to FIG. 1 through FIG. 5, an electrical extension cord assembly 10 is generally shown. It can be seen in FIG. 1 through FIG. 5 that the extension cord assembly 10 preferably includes a three-wire electrical cord 12 having a standard three prong, one-hundred and twenty volt (120 v) male plug 14 affixed to one end and a female receptacle head 16 attached to the other end.

Figure 2:
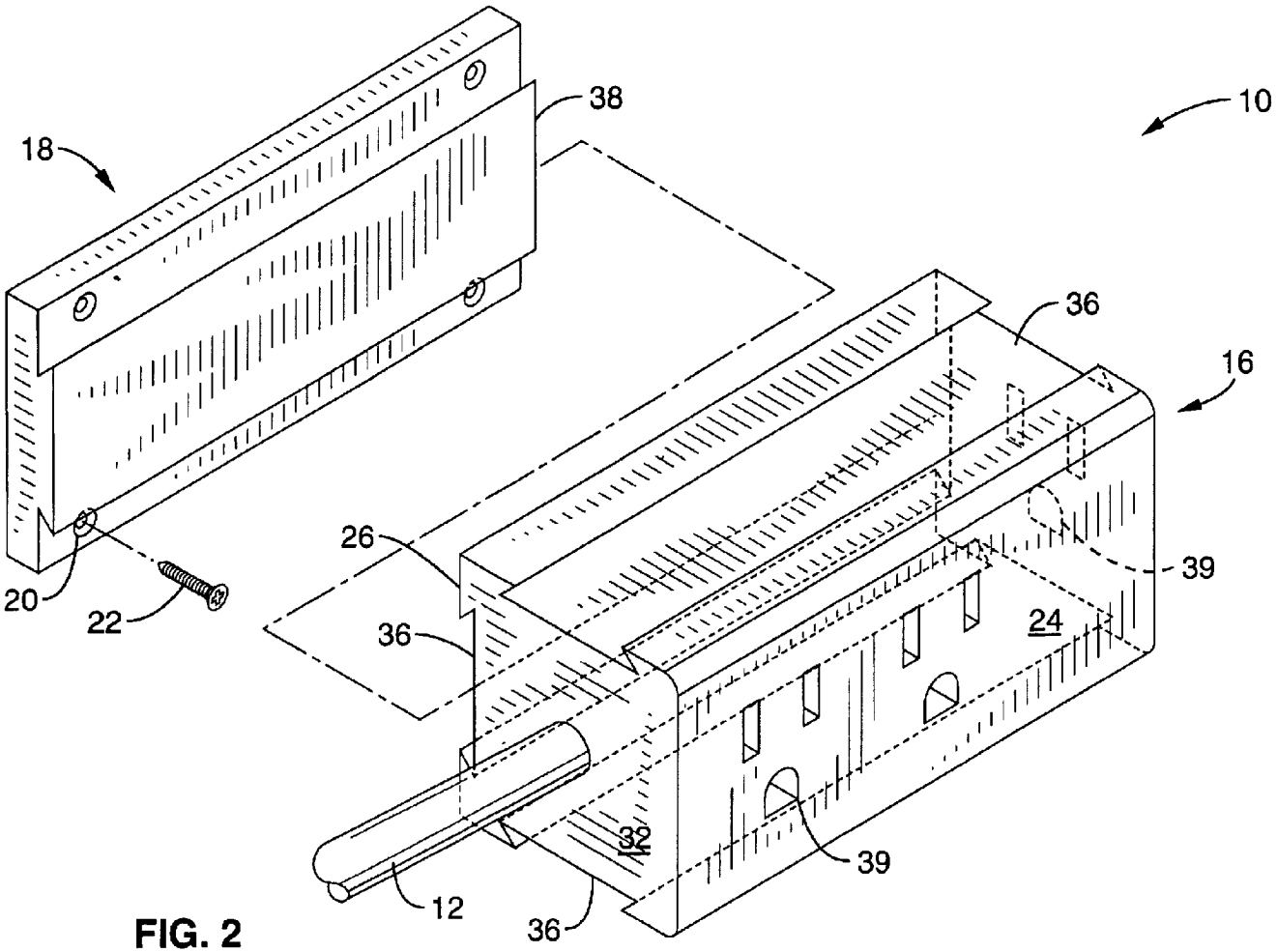
FIG. 2 is an exploded perspective view of the electrical extension cord assembly of FIG. 1 showing the head detached from the base plate.
Figure 4:
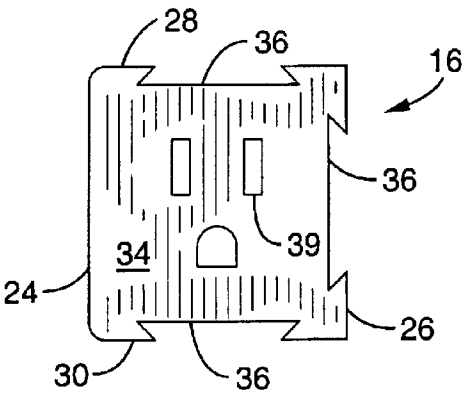
FIG. 4 is a side view of the embodiment of the extension cord head shown in FIG. 1.
Figure 3:
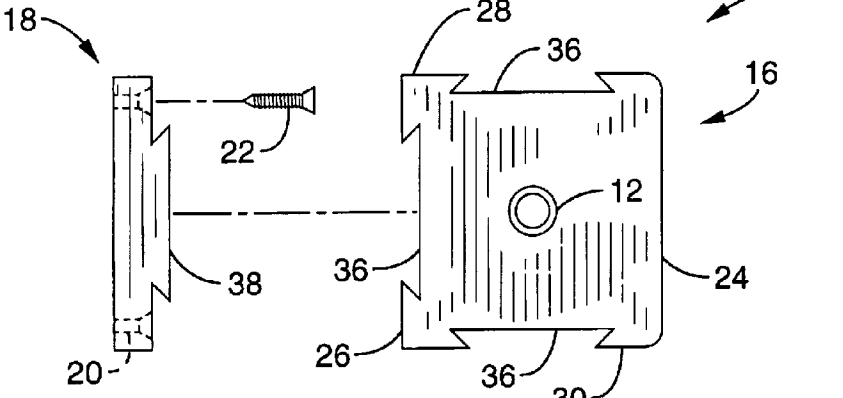
FIG. 3 is an exploded side view of the electrical extension cord assembly shown in FIG. 2.
Figure 5:
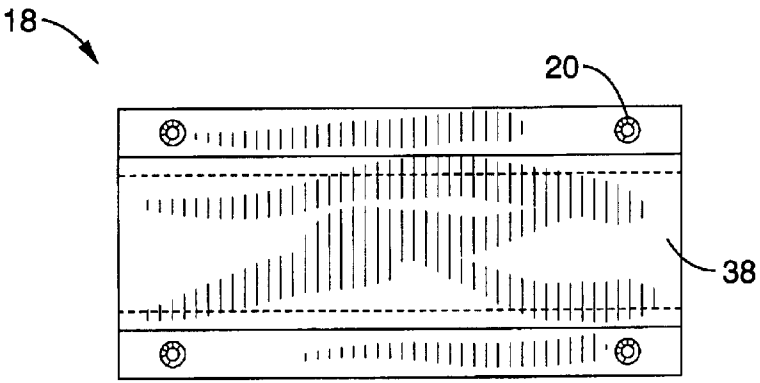
FIG. 5 is a front view of a base plate shown in FIG. 2.

Returning to FIG. 1 through FIG. 5, it is shown that the extension cord assembly 10 further includes a base plate 18 to which the head 16 can be removably attached. As shown in FIG. 2, FIG. 3, and FIG. 5, in a preferred embodiment, the base plate 18 is formed with four holes 20 through which fasteners 22, e.g., screws, bolts, nails, etc., can be inserted in order to attach the base plate 18 to a stationary object such as a wall.

It can be seen in FIG. 1 through FIG. 5 that the receptacle head 16 is generally box shaped and has a front face 24, a rear face 26, a top face 28, a bottom face 30, a left end face 32, and a right end face 34. As shown, the rear face 26, the top face 28, and the bottom face 30 are each formed with a generally dovetail-shaped groove 36.

On the other hand, the base plate 18 is formed with a dovetail-shaped tongue 38 that is sized to be received within any of the grooves 36 formed in the receptacle head. 16. It can be appreciated that the receptacle head 16 can be removably attached to the base plate 18 by sliding the receptacle head 16 relative to the base plate 18 such that one of the grooves 36 formed in the receptacle head 16 slides over the tongue 38 formed by the base plate 18.

Thus, when the receptacle head 16 is properly disposed on the base plate 18 it will be held in a fixed position. Moreover, if necessary, the receptacle head 16 can be easily detached from the base plate 18 by sliding the receptacle head 16 relative to the base plate 18 until the groove 36 completely disengages the tongue 38. It is to be understood that the receptacle head 16 is preferably formed with three grooves 26, as shown, to allow the receptacles, described below, that are formed in the front face of the receptacle head 16 to be oriented in three directions relative to the base plate 18, e.g., facing up, facing down, and facing forward relatively to a vertical base plate 18.

As shown, the head 16 can be a multi-tap head, i.e., the head 16 is formed with plural female receptacles 39. Conversely, the head 16 can be a single-tap head, i.e., the head 16 is formed with only a single female receptacle. It is to be understood that the preferred cord assembly 10 is configured to transmit power from standard 120 v alternating current (AC) wall outlets to devices that operate using 120 v AC. However, the cord assembly 10 may be easily modified to work in conjunction with nearly any type of outlet and device plug.

Figure 7:
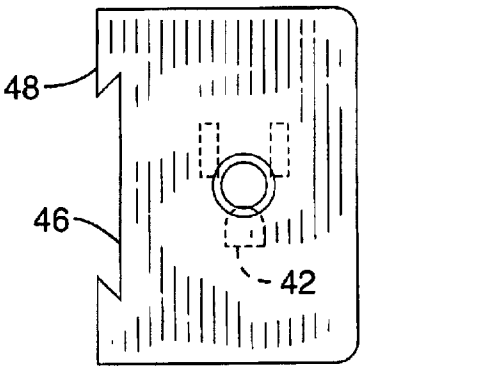
FIG. 7 is an end view of the alterative receptacle head of FIG. 6.
Figure 6:
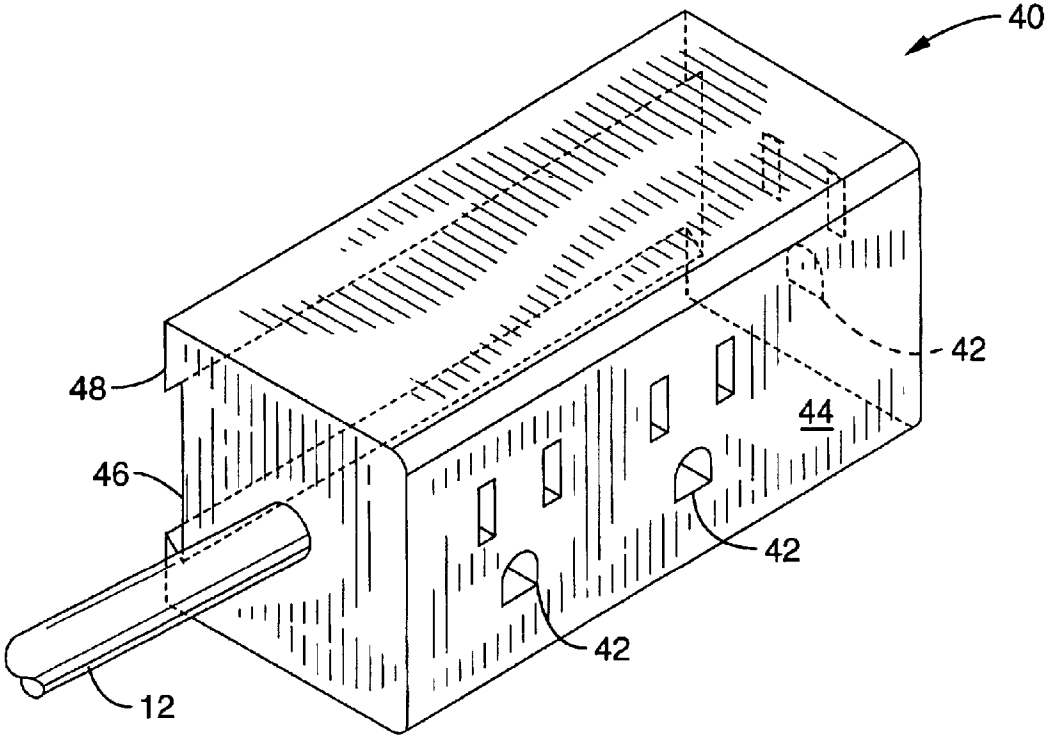
FIG. 6 is a perspective view of an alternative embodiment of a receptacle head according to the present invention.

FIG. 6 and FIG. 7 show an alternative receptacle head generally designated 40. In this embodiment, the receptacle head 40 includes a plurality of female receptacles 42 formed in a front face 44 of the head 40 and one female receptacle 42 formed in a right end face (not shown) of the receptacle head 40. As shown in FIG. 6 and FIG. 7, the receptacle head 40 is formed with a single dovetail slot 46 in a rear face 48 of the head 40. Thus, the receptacle head 40 can only be mounted in one direction relative to a base plate, e.g., the base plate 18 shown in FIG. 1 through FIG. 5.

Figure 9:
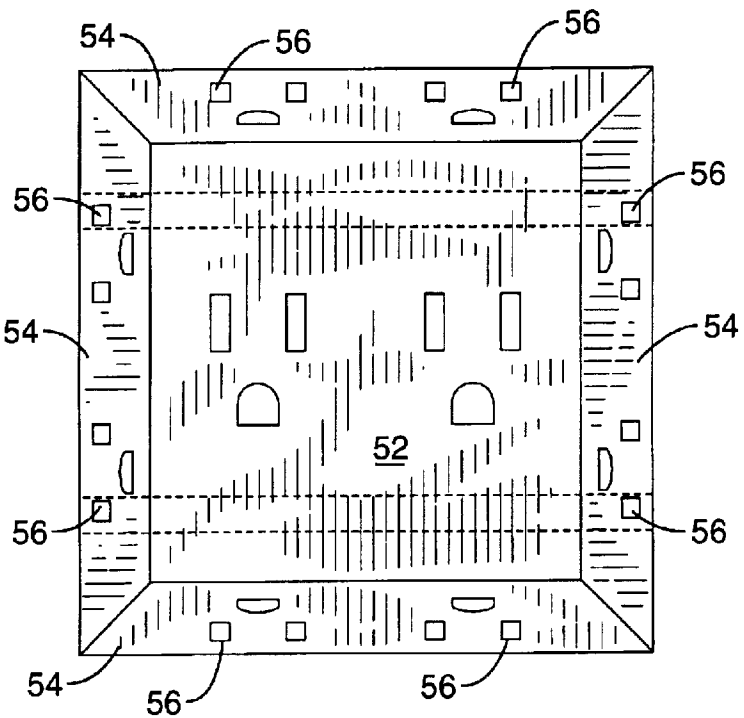
FIG. 9 is a front view of the second alternative receptacle head of FIG. 8.
Figure 8:
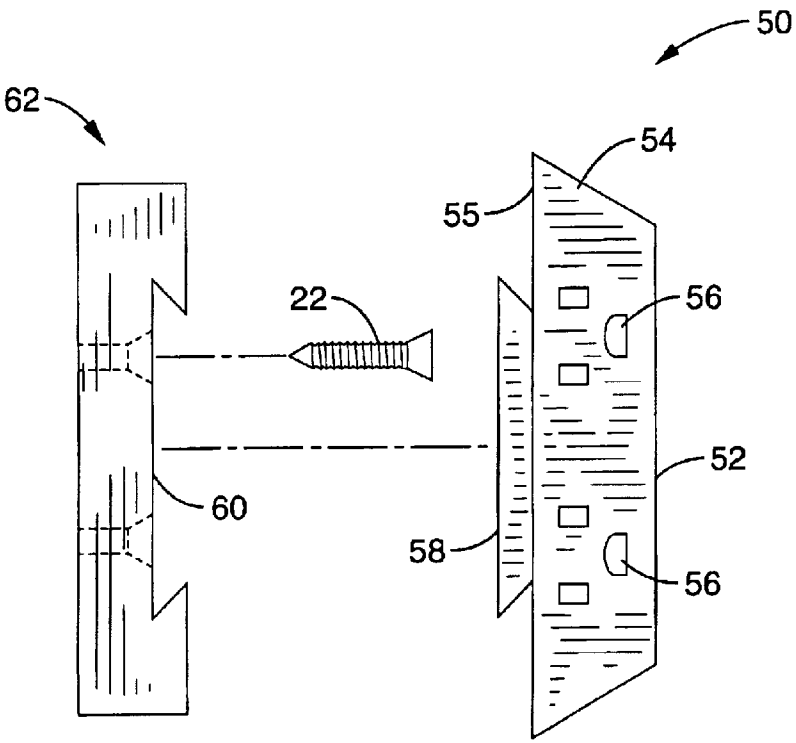
FIG. 8 is a side view of a second alternative embodiment of a receptacle head and base plate according to the present invention.

Referring now to FIG. 8 and FIG. 9, a second alternative receptacle head is shown and generally designated 50. FIG. 8 and FIG. 9 show that this embodiment of the receptacle head 50 includes a front face 52 surrounded by four beveled faces 54. As shown, each face 52, 54 can be preferably formed with two female receptacles 56. Moreover, as shown in FIG. 8 and FIG. 9, a dovetail-shaped tongue 58 extends from a rear face 55 at the back of the receptacle head 50 opposite the front face 52. The dovetail-shaped tongue 58 is configured to engage a dovetail shaped groove 60 formed in a base plate 62. Thus, the receptacle head 50 can be removably attached to the base plate 62. Also, each face 52, 54 of the receptacle head 50 provides female receptacles 56 oriented in five directions relative to the base plate 62,. i.e., facing up, facing down, facing left, facing right, and facing forward relative to a vertical base plate 62.

Figure 10:
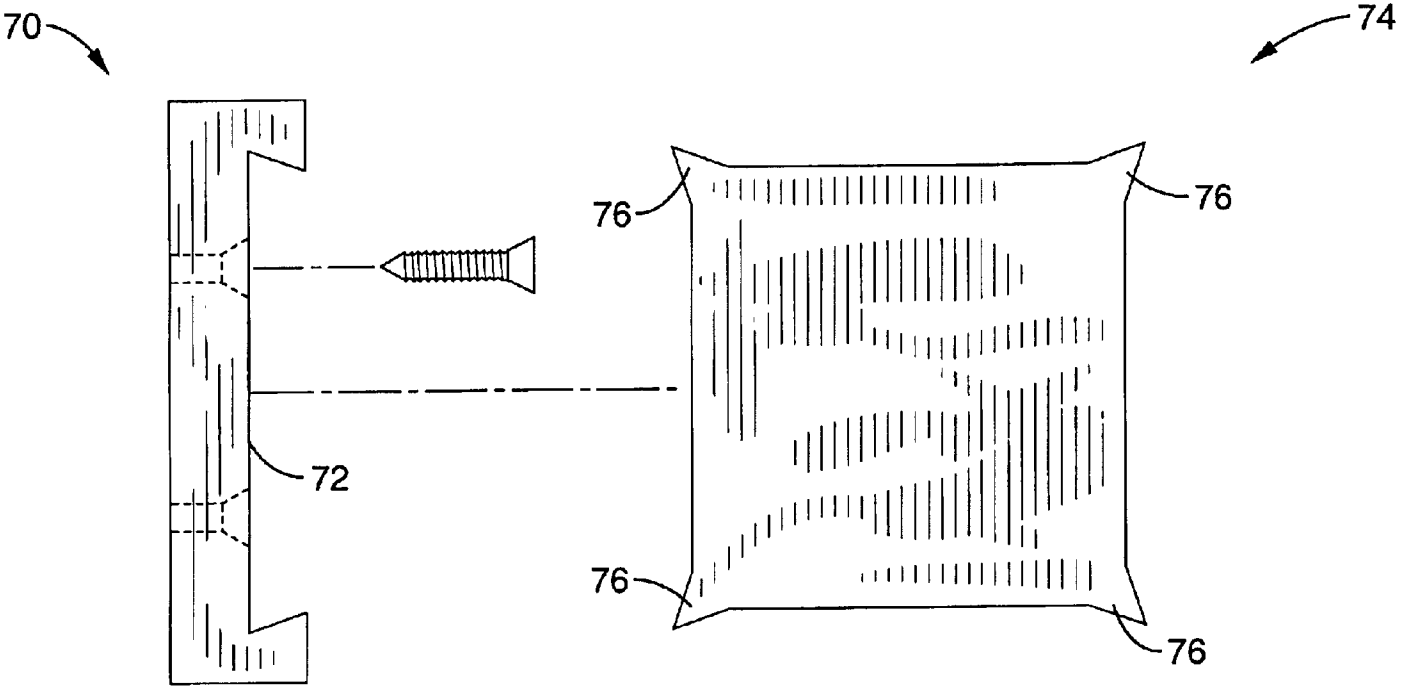
FIG. 10 is a side view of an alternative mounting system according to the present invention.
Figure 11:
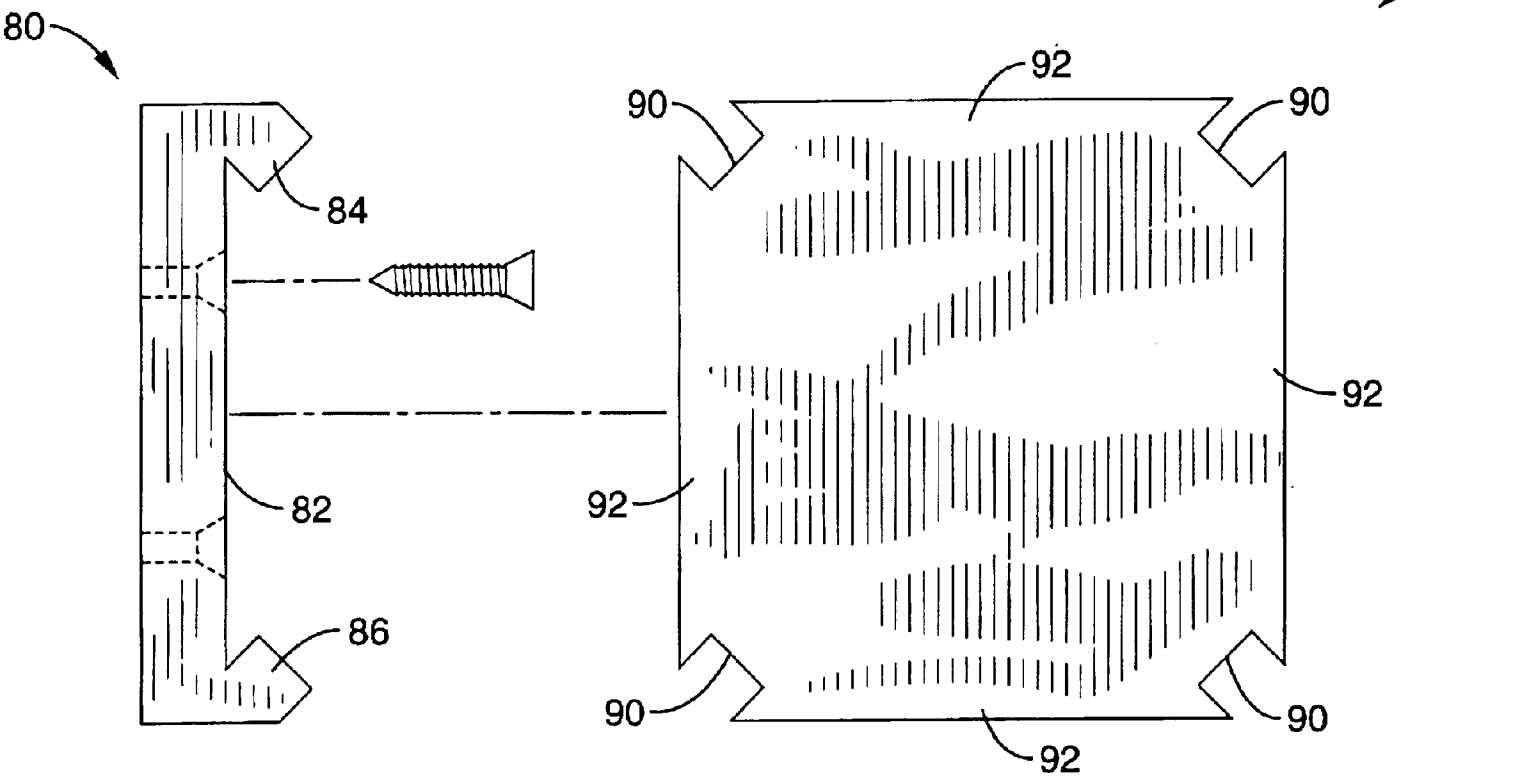
FIG. 11 is a side view of a second alternative mounting system according to the present invention.
Figure 12:
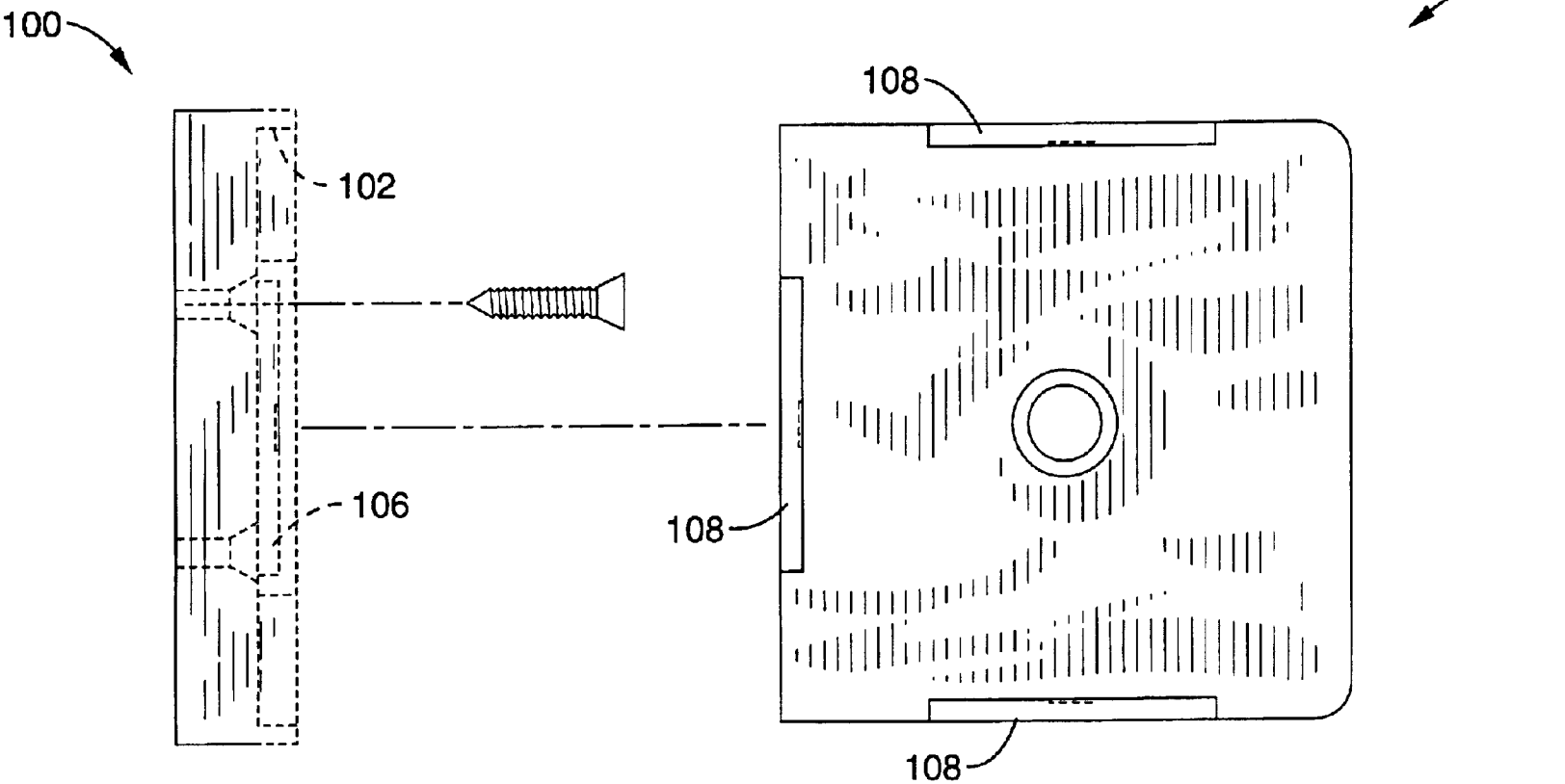
FIG. 12 is a side view of a third alternative mounting system according to the present invention.

FIG. 10 through FIG. 12 show three alternate mounting systems for the electrical extension cord assembly of the present invention, e.g., the preferred extension cord assembly 10 shown in FIG. 1 through FIG. 5. Specifically, FIG. 10 shows abase plate 70 formed with a dovetail-shaped groove 72. A receptacle head 74 is formed with four ears 76 at each corner of the receptacle head 74 and extend along the length of the receptacle head 74, i.e., into the page looking at FIG. 10. These ears 76 can engage the groove 72 two at a time in order to securely fasten the receptacle head 74 to the base plate 70.

FIG. 11 shows a base plate 80 that is formed with a dovetail-shaped groove 82 flanked by an upper tab 84 and a lower tab 86. These tabs 84, 86 extend along the entire length of the groove 82, i.e., into the page looking at FIG. 11. As shown in FIG. 11, a receptacle head 88 is formed with a rectangular slot 90 in each corner of the generally box-shaped receptacle head 88. Moreover, a dovetail-shaped tongue 92 is formed between each consecutive pair of slots 90 so that there are four tongues 92 around the perimeter of the receptacle head 88. Accordingly, the receptacle head 88 can slidably engage the base plate 80 so that it will be securely fastened thereto. In other words, each tongue 92 can be inserted one at a time in the groove 82 while the tabs 84, 86 that flank the groove 82 fit into the slots 90 that flank each tongue 92.

In another alternative mounting system, shown in FIG. 12, a base plate 100 can be formed with a rectangular indentation 102 that is sized and shaped so that a receptacle head 104 can be partially inserted into the base plate 100. A slot 106 is formed at each end of the rectangular indentation 102. Further, as shown, three tabs 108 extend perpendicularly from each end of the receptacle head 104 along the longitudinal axis so that there are six tabs 108 total with three opposing pairs. In accordance with this embodiment, the tabs 108 fit into the slots 106 to allow the receptacle head 104 to be snapped in place within the indentation formed by the base plate 100.

Figure 15:
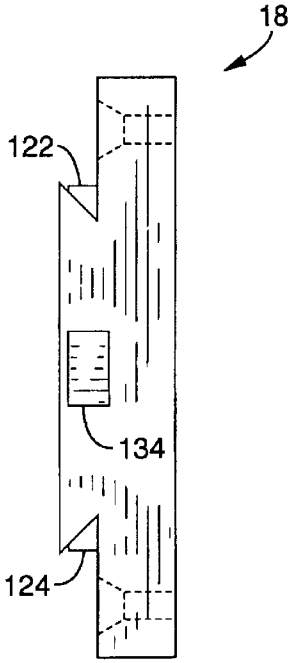
FIG. 15 is a side view of the locking mechanism of FIG. 13.
Figure 13:
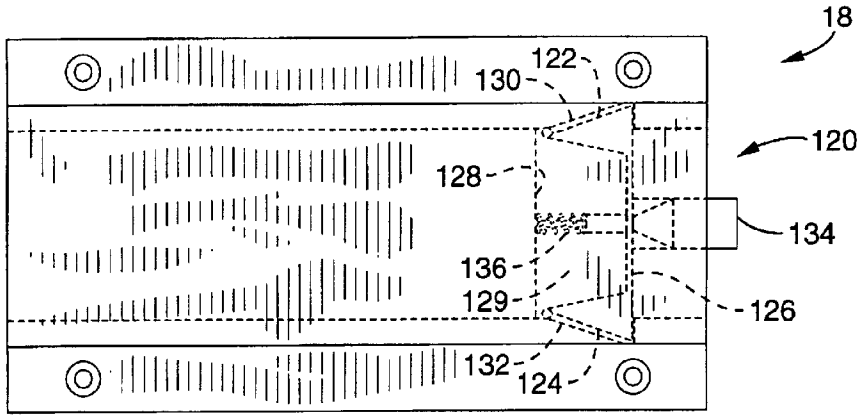
FIG. 13 is a front view of a locking mechanism for an extension cord assembly of FIG. 1 in the locked position.
Figure 14:
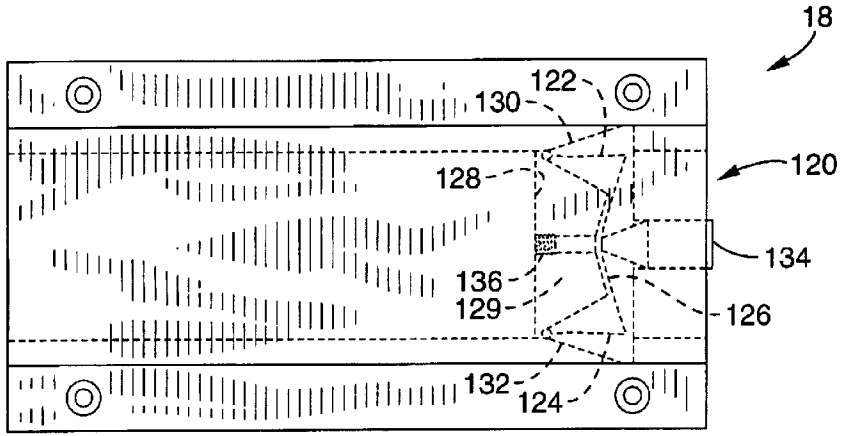
FIG. 14 is a front view of the locking mechanism of FIG. 13 in the unlocked position.

Referring now to FIG. 13 through FIG. 15 a locking mechanism is shown and generally designated 120. The locking mechanism 120 is used to prevent a receptacle head, e.g., the receptacle head 16 shown in FIG. 1 through FIG. 5, from sliding off of a base plate, e.g., the base plate 18 also shown in FIG. 1 through FIG. 5. As shown, the locking mechanism 120 includes an upper generally triangular-shaped tab 122 and a lower generally triangular-shape tab 124. The base of the upper tab 122 is connected to the base of the lower tab 124 by a relatively thin, flat diaphragm 126. The narrow ends of the tabs 122, 124 maintain contact with a locking mechanism support face 128 established by the base plate 18 adjacent to an inner cavity 129 therein. As shown, the tabs 122, 124 extend from within the interior of the base plate 18 through respective openings 130, 132 formed by the base plate 18. Thus, the tabs 122, 124 can engage corresponding notches, described below, that are formed by the receptacle head 16.

FIG. 13 through FIG. 15 further show that a release button 134 is installed within the end of the base plate 18 so that one end of the button 134 is external to the base plate 18 and the other end contacts the diaphragm 128. As shown, a spring 136 is installed in compression between the diaphragm 126 and the support face 128.

As shown in FIG. 14, when the button 134 is depressed, the diaphragm 126 is bent at the center. In turn, the tabs 122, 124 pivot about their narrow ends that contact the support face 128. This causes the base of each tab 122, 124 to be drawn into the interior of the base plate 18. Thus, the locking mechanism 120 is in the unlocked position and the receptacle head 16 can be slidably removed from the base plate 18. When the button 134 is released the spring 136 returns the locking mechanism 120 to the locked position shown in FIG. 13.

Figure 16:
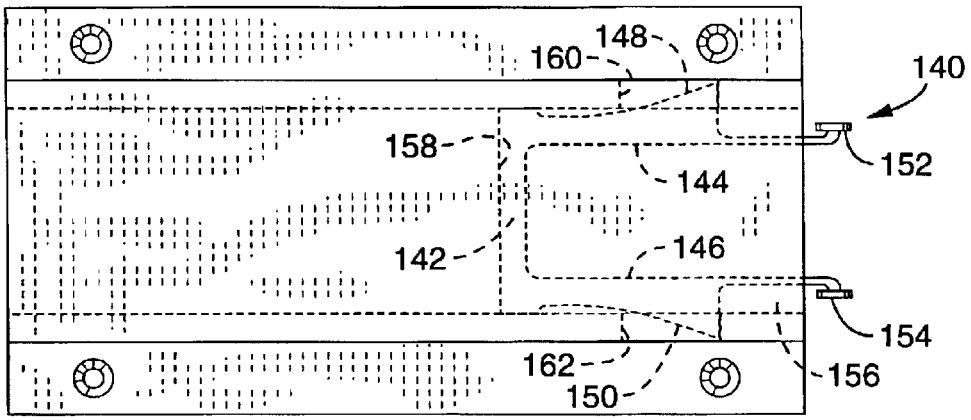
FIG. 16 is a front view of an alterative locking mechanism for an extension cord assembly of FIG. 1 in the locked position.
Figure 17:
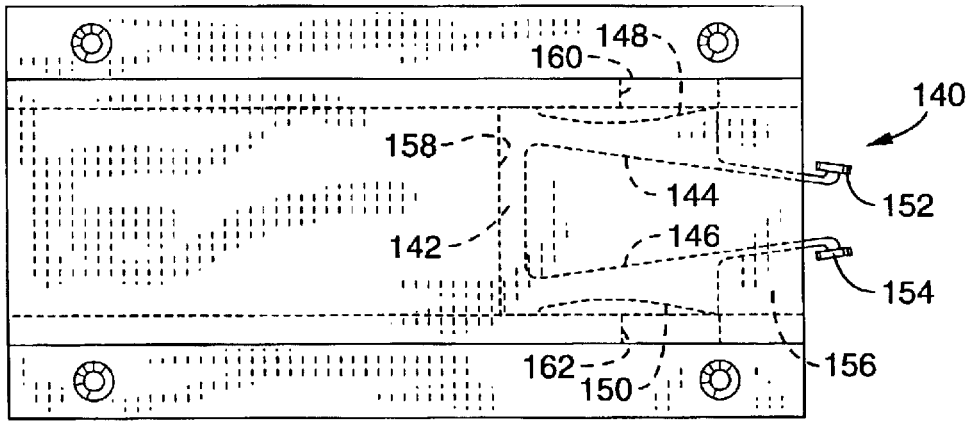
FIG. 17 is a front view of the alternative locking mechanism of FIG. 1 in the unlocked position.
Figure 18:
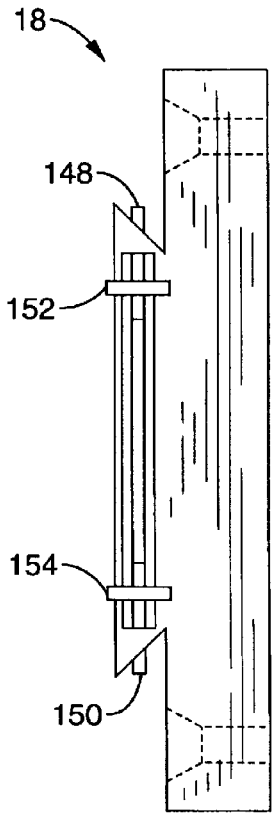
FIG. 18 is a side view of the alternative locking mechanism of FIG. 16.

FIG. 16 through FIG. 18 show an alternative locking mechanism generally designated 140. As shown, this embodiment of the locking mechanism. 140 includes a base 142 having an upper arm 144 and a lower arm 146 extending perpendicularly therefrom. Additionally, an upper ramped tab 148 extends outwardly, i.e., up, from the upper arm 144 and a lower ramped tab 150 extends outwardly, i.e., down, from the lower arm 146. FIG. 16 through FIG. 18 also show that the ends of each arm 144, 146 include respective push plates 152, 154 that allow a user to unlock the mechanism 140, as described in detail below.

As shown in FIG. 16 and FIG. 17, the base plate 18 is formed with an interior cavity 156 in which the locking mechanism 140 can be installed. The base plate 18 also establishes a locking mechanism support face 158 against which the locking mechanism 140 rests when installed in the interior cavity 156 of the base plate 18. Additionally, the base plate 18 forms an upper tab opening 160 and a lower tab opening 162. As shown, when the locking mechanism 140 is installed in the base plate 18, the push plates 152, 154 attached to the arms 144, 146 and a portion of each ramped tab 148, 150 extend outside the interior cavity 156 of the base plate 18. The ramped tabs 148, 150 engage respective notches, described below, that are formed by a receptacle head such as the receptacle head 16 shown in FIG. 1 through FIG. 5.

When a user squeezes the push plates 152, 154 toward each other, the ramped tabs 148 are moved into the interior cavity 156 of the base plate 18. Thus, the locking mechanism 140 is in the unlocked position, shown in FIG. 17, and the receptacle head 16 can be slidably removed from the base plate 18. When the push plates 152, 154 are released, the arms 144, 146 return to their original positions so that the locking mechanism 140 is in the locked position shown in FIG. 16.

Figure 19:
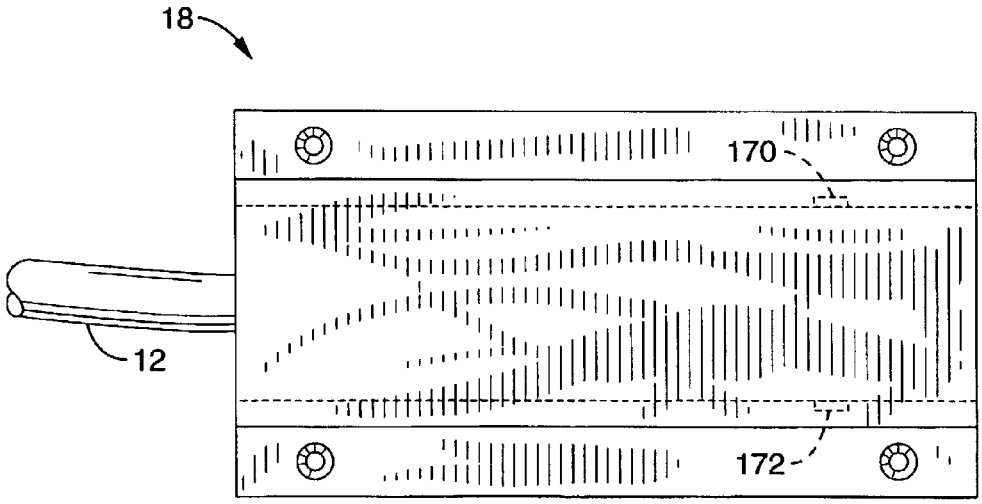
FIG. 19 is a rear view of an extension cord head.

Referring now briefly to FIG. 19, the back of a receptacle head, such as the receptacle head 16 described in conjunction with FIG. 1 through FIG. 5, is shown. FIG. 19 shows that the receptacle head 16 is formed with an upper notch 170 and a lower notch 172. These notches 170, 172 are configured to engage the tabs 122, 124, 148, 150 of either locking mechanism 120, 140 in order to secure the receptacle head 16 to the base plate.

With the configuration of structure described below, it can be appreciated that the present invention provides a means by which a female receptacle head of an extension cord can be relatively easily attached to and removed from a base plate. Also, a relatively secure connection is provided between the receptacle head and the base plate.

Accordingly, it will be seen that this invention is an extension cord apparatus that has a cord head configured to reversibly engage a base plate that is mounted to the underside of a table, a wall or other convenient location. The head can be positioned at convenient points of access rather than placed on the floor or ground to be potentially exposed to water or dust or the like. Although the description above contains many specificities, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An extension cord assembly providing multi-positional fixed mounting, comprising:

an electrical cord;

said electrical cord having a first end and a second end;

a plug attached to said first end of said electrical cord;

a receptacle head attached to said second end of said electrical cord;

said receptacle head including at least one plug receiving socket;

a base plate;

said base plate being attachable to an object;

said receptacle head having a plurality of sides wherein at least a first and second side are configured for attachment to said base plate; and means for removably attaching said sides of said receptacle head to said base plate in at least first and second positions, whereby the position of said receptacle head on said base plate is reconfigurable.

2. An extension cord assembly as recited in claim 1, wherein said means for removably attaching said receptacle head to said base plate comprises:

at least one groove on said base plate; and at least first and second tongues on said receptacle h ad;

wherein said tongue is slidably engageable with said first groove to secure said receptacle head to said base plate in said first position; and wherein said tongue is slidably engageable with said second groove to secure said receptacle head to said plate in said second position.

3. An extension cord assembly as recited in claim 2, wherein said tongue and grooves are dovetail shaped.

4. An extension cord assembly as recited in claim 1, wherein said means for removably attaching said receptacle head to said base plate comprises:

at least one tongue on said base plate; and at least first and second and second grooves on said receptacle head;

wherein said tongue is slidably engageable with said first groove to secure said receptacle head to said base plate in said first position; and wherein said tongue is slidably engageable with said second groove to secure said receptacle head to said base plate in said second position.

5. An extension cord assembly as recited in claim 4, wherein said tongue and grooves are dovetail shaped.

6. An extension cord assembly as recited in claim 1, further comprising:

a locking mechanism associated with said base plate;

wherein said locking mechanism is engageable with said receptacle head to lock said receptacle head to said base plate.

7. An extension cord assembly as recited in claim 6:

wherein said locking mechanism comprises at least two tabs engageable with at least two corresponding notches formed by said receptacle head; and wherein said tabs are movable between a locked position wherein said receptacle head cannot be removed from said base plate and an unlocked position wherein said receptacle head can be slidably removed from said base plate.

8. An extension cord assembly as recited in claim 1:

wherein said receptacle head defines a first end and a second end;

wherein said receptacle head further includes at least one tab extending from said first end and at least one tab extending from said second end opposite said first tab;

wherein said base plate includes at least two slots configured to engage said tabs; and wherein said receptacle head is snappingly engageable with said base plate.

9. An extension cord assembly providing multi-positional fixed mounting, comprising:

an electrical cord;

said electrical cord having a first end and a second end;

a plug attached to said first end of said electrical cord;

a receptacle head attached to said second end of said electrical cord;

said receptacle head including at least one plug receiving socket; and a base plate;

said base plate being attachable to a object;

said receptacle head having a plurality of sides wherein at least a first and second side are configured for attachment to a base plate;

wherein said at least first and second sides of said receptacle head are removably attachable to said base plate in at least first and second positions, whereby the position of said receptacle head is reconfigurable.

10. An extension cord assembly as recited in claim 9, further comprising:

at least one groove on said base plate; and at least first and second tongues on said receptacle head;

wherein said tongue is slidably engageable with said first groove to secure said receptacle head to said base plate in a first position; and wherein said tongue is slidably engageable with said second groove to secure said receptacle head to said plate in a second position.

11. An extension cord assembly as recited in claim 10, wherein said tongue and grooves are dovetail shaped.

12. An apparatus extension cord assembly as recited in claim 9, further comprising:

at least one tongue on said base plate; and at least first and second and second grooves on said receptacle head;

wherein said tongue is slidably engageable with said first groove to secure said receptacle head to said base plate in said first position; and wherein said tongue is slidably engageable with said second groove to secure said receptacle head to said base plate in said second position.

13. An extension cord assembly as recited in claim 12, wherein said tongue and grooves are dovetail shaped.

14. An extension cord assembly as recited in claim 9, further comprising:

a locking mechanism associated with said base plate;

wherein said locking mechanism is engageable with said receptacle head to lock said receptacle head to said base plate.

15. An extension cord assembly as recited in claim 14:

wherein said locking mechanism comprises at least two tabs engageable with at least two corresponding notches formed by said receptacle head; and wherein said tabs are movable between a locked position wherein said receptacle head cannot be removed from said base plate and an unlocked position wherein said receptacle head can be slidably removed from said base plate.

16. An extension cord assembly as recited in claim 9:

wherein said receptacle head defines a first end and a second end;

wherein said receptacle head further includes at least one tab extending from said first end and at least one tab extending from said second end opposite said first tab;

wherein said base plate includes at least two slots configured to engage said tabs; and wherein said receptacle head is snappingly engageable with said base plate.

17. An extension cord assembly as recited in claim 1, wherein said means for removably attaching said receptacle head to said base plate is configured for manual separation or attachment without inserting or removing fasteners.

18. An extension cord assembly as recited in claim 1, wherein said first and second positions of said receptacle head are obtained in response to mounting a first or second portion of said receptacle head to said base plate.

19. An extension cord assembly as recited in claim 9, wherein said means for removably attaching said receptacle head to said base plate is configured for manual separation or attachment without inserting or removing fasteners.

20. An extension cord assembly as recited in claim 9, wherein said first and second positions of said receptacle head are obtained in response to mounting a first or second portion of said receptacle head to said base plate.

21. An extension cord assembly providing multi-positional fixed mounting, comprising:

an electrical cord having a first end and a second end;

a plug attached to said first end of said electrical cord;

a receptacle head attached to said second end of said electrical cord;

said receptacle head including at least one plug receiving socket;

a base plate configured for attachment to an object; and means for removably attaching at least a first or second portion of said receptacle head to said base plate for reconfiguring the position of said receptacle head on said base plate in at least a first or second position.

22. An extension cord assembly providing multi-positional fixed mounting, comprising:

an electrical cord having a first end and a second end;

a plug attached to said first end of said electrical cord;

a receptacle head attached to said second end of said electrical cord;

said receptacle head including at least one plug receiving socket;

a base plate configured for attachment to an object; and said receptacle head being configured to allow multiple sides of said receptacle head to be slidably engaged with said base plate allowing the position of said receptacle head to be reconfigured.

23. An extension cord assembly as recited in claim 22, further comprising a locking mechanism which is engaged as said receptacle head and said base plate are slidably engaged.

24. An extension cord assembly as recited in claim 23, further comprising means for selective locking of said receptacle head to said base plate.

25. An extension cord assembly as recited in claim 24:

wherein said selective locking means comprises at least one release button or push-plate biased toward a first position which locks said receptacle head to said base plate;

wherein activation of said release button or push-plate releases the lock allowing said receptacle head to be slidably disengaged from said base plate.

26. An extension cord assembly as recited in claim 23, wherein said locking mechanism comprises mating tabs and notches.

27. An extension cord assembly as recited in claim 22, wherein electrical power is not routed through said base plate to said plug receiving socket within said receptacle head.

28. An extension cord assembly as recited in claim 22, wherein said configuration of said receptacle head and said base plate for slidable engagement comprises mating tongue and groove surfaces.

29. An extension cord assembly as recited in claim 28, wherein said tongue and grooves are dovetail shaped.

30. An extension cord assembly as recited in claim 28, wherein said base plate is configured with a groove into which a tongue from at least a first position or second position on said receptacle head may be slidably engaged.

31. An extension cord assembly providing multi-positional fixed mounting, comprising:

an electrical cord having a first end and a second end;

a plug attached to said first end of said electrical cord;

a receptacle head attached to said second end of said electrical cord;

said receptacle head including at least one plug receiving socket; and a base plate configured for attachment to an object;

said receptacle head configured to allow multiple sides of said receptacle head to be snappably engaged with said base plate allowing reconfiguring the position of said receptacle head.

32. An extension cord assembly as recited in claim 31, wherein electrical power is not routed through said base plate to said plug receiving socket within said receptacle head.

33. An extension cord assembly as recited in claim 31, wherein said configuration of said receptacle head and said base plate for snappable engagement comprises tabs and slots which engage one another and are snapped together.

34. An extension cold assembly as recited in claim 31, wherein said receptacle head is configured with two tabs that engage two correspondingly sized and shaped slots in said base plate into which said tabs can be snapped into place to secure said receptacle head to said base plate.

35. An extension cord assembly allowing multi-positional fixed mounting, comprising:

an electrical cord having a first end and a second end;

a plug attached to said fist end of said electrical cord;

a receptacle head attached to said second end of said electrical cord;

said receptacle head including at least one plug receiving socket;

a base plate configured for attachment to an object;

at least one groove on said base plate; and at least first and second tongues on said receptacle head;

wherein said tongue is slidably engageable with said first groove or said second groove to secure said receptacle head to said base plate in a first position or a second position;

whereby the position of said receptacle head is reconfigurable on said base plate.

36. An extension cord assembly as recited in claim 35, wherein said tongue and grooves am dovetail shaped.

37. An extension cord assembly providing multi-positional fixed mounting, comprising:

an electrical cord having a first end and a second end;

plug attached to said first end of said electrical cord;

a receptacle head attached to said second end of said electrical cord;

said receptacle head including at least one plug receiving socket;

a base plate configured for attachment to an object;

at least one tongue on said base plate; and at least first and second and second grooves on said receptacle head;

wherein said tongue is slidably engageable with said first groove or said second groove to secure said receptacle head to said base plate in a first position or a second position;

whereby the position of said receptacle head on said base plate is reconfigurable.

38. An extension cord assembly as recited in claim 37, wherein said tongue and grooves are dovetail shaped.

39. An extension cord assembly providing multi-positional fixed mounting, comprising:

an electrical cord having a first end and a second end;

a plug attached to said first end of said electrical cord;

a receptacle head attached to said second end of said electrical cord;

said receptacle head including at least one plug receiving socket;

a base plate configured for attachment to an object; and a locking mechanism associated with said base plate;

wherein said locking mechanism is engageable with said receptacle head to lock said receptacle head to said base plate;

wherein said locking mechanism comprises at least two tabs engageable with at least two corresponding notches formed by said receptacle head;

wherein said tabs are movable between a locked position wherein said receptacle head cannot be removed from said base plate and an unlocked position wherein said receptacle head can be slidably removed from said base plate.

40. An extension cord assembly providing multi-positional fixed mounting, comprising:

an electrical cord having a first end and a second end;

a plug attached to said first end of said electrical cord;

a receptacle head attached to said second end of said electrical cord;

said receptacle head including at least one plug receiving socket; and a base plate configured for attachment to an object:

wherein said receptacle head defines a first end and a second end;

wherein said receptacle head further includes at least one tab extending from said first end and at least one tab extending from said second end opposite said first tab;

wherein said base plate includes at least two slots configured to engage said tabs; and wherein said receptacle head is snappingly engageable upon said base plate.

41. An extension cord assembly providing multi-positional fixed mounting, comprising:

an electrical cord having a first end and a second end;

a plug attached to said first end of said electrical cord;

a receptacle head attached to said second end of said electrical cord;

said receptacle head including at least one plug receiving socket;

a base plate configured for attachment to an object;

wherein said receptacle head is removably attachable to said base plate in at least a first and second positions, whereby the position of said receptacle head is reconfigurable;

at least one groove on said base plate; and at least first and second tongues on said receptacle head;

wherein said first tongue is configured to slidably engage said groove to secure said receptacle head to said base plate in a first position; and wherein said second tongue is configured to slidably engage said groove to secure said receptacle head to said base plate in a second position.

42. An extension cord assembly as recited in claim 41, wherein said tongue and grooves are dovetail shaped.

43. An extension cord assembly providing multi-positional fixed mounting, comprising:

an electrical cord having a first end and a second end;

a plug attached to said first end of said electrical cord;

a receptacle head attached to said second end of said electrical cord;

said receptacle head including at least one plug receiving socket;

a base plate configured for attachment to an object;

wherein said receptacle head is removably attachable to said base plate in at least first and second positions, whereby the position of said receptacle head is reconfigurable;

at least one tongue on said base plate; and at least first and second and second grooves on said receptacle head;

wherein said tongue is slidably engageable with said first groove to secure said receptacle head to said base plate in a first position; and wherein said tongue is slidably engageable with said second groove to secure said receptacle head to said base plate in a second position.

44. An extension cord assembly as recited in claim 43, wherein said tongue and grooves are dovetail shaped.

45. An extension cord assembly providing multi-positional fixed mounting, comprising:

an electrical cord having a first end and a second end;

a plug attached to said first end of said electrical cord;

a receptacle head attached to said second end of said electrical cord;

said receptacle head including at least one plug receiving socket;

a base plate configured for attachment to an object;

wherein said receptacle head is removably attachable to said base plate in at least first and second positions, whereby the position of said receptacle head is reconfigurable; and a locking mechanism associated with said base plate;

wherein said locking mechanism is engageable with said receptacle head to lock said receptacle head to said base plate;

wherein said locking mechanism comprises at least two tabs engageable with at least two corresponding notches formed by said receptacle head; and wherein said tabs are movable between a locked position wherein said receptacle head cannot be removed from said base plate and an unlocked position wherein said receptacle head can be slidably removed from said base plate.

46. An extension cord assembly providing multi-positional fixed mounting, comprising:

an electrical cord having a first end and a second end;

a plug attached to said first end of said electrical cord;

a receptacle head attached to said second end of said electrical cord;

said receptacle head including at least one plug receiving socket; and a base plate configured for attachment to an object;

wherein said receptacle head is removably attachable to said base plate in at least first and second positions, whereby the position of said receptacle head is reconfigurable;

wherein said receptacle head defines a first end and a second end;

wherein said receptacle head further includes at least one tab extending from each of said first end and said second end opposite said first tab; and wherein said base plate includes at least two slots configured to engage said tabs;

wherein said receptacle head is snappingly engageable with said base plate.

* * * * *